United States Patent [19]

Beurich et al.

[11] Patent Number: 4,752,354

[45] Date of Patent: Jun. 21, 1988

[54] PROCESS AND COMPOSITION FOR BLEACHING WOOD PULP

[75] Inventors: Harald Beurich, Ladenburg; Margarete Scholl, Mannheim, both of Fed. Rep. of Germany

[73] Assignee: Benckiser-Knapsack GmbH, Ladenburg, Fed. Rep. of Germany

[21] Appl. No.: 887,428

[22] Filed: Jul. 21, 1986

[30] Foreign Application Priority Data

Sep. 4, 1985 [DE] Fed. Rep. of Germany ..... 3531563

[51] Int. Cl.[4] ..... D21C 3/20

[52] U.S. Cl. ..... 162/72; 162/76; 162/78; 162/80; 162/84

[58] Field of Search ..... 162/72, 78, 80, 182, 162/82, 83, 84

[56] References Cited

U.S. PATENT DOCUMENTS 4,599,138 7/1986 Lindahl ..... 162/78 X

FOREIGN PATENT DOCUMENTS 0141355 5/1985 European Pat. Off. .

OTHER PUBLICATIONS

Chem. Abst., CA 103(14):106550q; Abstract of EP 141355, 5-15-85.

H. U. Suess, "Zur Bleiche von Holzstoffen auf hohe und hoechste Weissgehalte", Wochenblatt for Papierfabrikation, vol. 6, pp. 179-180, 1982.

*Primary Examiner*—Peter Chin

*Assistant Examiner*—Thi Dang

*Attorney, Agent, or Firm*—Foley & Lardner, Schwartz, Jeffery, Schwaab, Mack, Blumenthal & Evans

[57] ABSTRACT

A process for the oxidative or reductive bleaching of wood pulp, especially in the presence of heavy metal salts, in which a complex former combination containing at least one phosphonic acid, at least one polyhydroxycarboxylic acid and at least one phosphate or salts thereof is added to a wood pulp slurry in an amount of from 0.5 to 50%, based on the dry mass of the wood pulp, and subsequent bleaching is carried out in the presence of a reducing agent. Also provided is a complex former combination for use in the oxidative or reductive bleaching of wood pulp, comprising at least one phosphonic acid, at least one polyhydroxycarboxylic acid and at least one phosphate or salts thereof.

9 Claims, No Drawings

PROCESS AND COMPOSITION FOR BLEACHING WOOD PULP

BACKGROUND OF THE INVENTION

The present invention relates to a process and agent for bleaching wood pulp. More particularly, the present invention is concerned with adjuvants for bleaching thermorefined wood pulp (TMP), chemothermorefined wood pulp (CTMP), mechanical wood pulp, cellulose and waste paper by means of peroxides or salts of dithionic acid and derivatives thereof and of sulphurous acid, as well as derivatives thereof.

Bleaching of wood pulp which is necessary for the use thereof in the production of paper generally takes place with the help of an oxidative or reductive bleaching. The bleaching can be carried out in one or two steps.

The bleaching agent is influenced by the kind of wood, the wood pretreatment, the amount of bleaching agent, the quality of the water, the manner of dosing it in and the nature of the additives used. The average increase of the degree of whiteness is from 8 to 10 points in the case of a one-step bleaching and is from 16 to 18 points in the case of a two-step bleaching.

It is known that the stabilization of the bleaching solution necessary for the achievement of the desired degree of whiteness is, in the case of hydrogen peroxide, carried out with the help of waterglass. However, the use of waterglass leads to processing problems which are brought about, for example, by depositions in the machine parts used and difficulties in the clarification of waste water. For the reduction of these problems, it is necessary to use an increased amount of chemical adjuvants which, in turn, gives rise to new problems when, as is known, the process is carried out in a cycle.

Furthermore, the dosing of waterglass is problematic, the reason for which, in turn, is due to the quality of the water used. Hitherto, it has not been possible to make available products which permit a complete replacement of waterglass in the bleaching of wood pulp, not only in the case of oxidative but also in the case of reductive bleaching.

SUMMARY OF THE INVENTION

Therefore, it is an object of the present invention to provide an improved process for bleaching wood pulp.

Another object of the invention is to provide a complex former composition for use in a wood pulp bleaching process.

It is a particular object of the invention to provide products which can be equally satisfactorily used in both oxidative and reductive bleaching processes.

Still another object of the invention is to provide an improved bleaching bath which employs the complex former compositions of the invention.

In accomplishing these objects, there has been provided in accordance with one aspect of the invention a process for bleaching wood pulp, comprising the step of oxidatively or reductively bleaching a wood pulp slurry in the presence of an amount of from about 0.5 to 50% by weight based upon the dry mass of the wood pulp of a complex former combination comprising as components at least one phosphonic acid, at least one polyhydroxy carboxylic acid and at least one phosphate, or salts of said components, wherein at least a portion of said bleaching step is carried out in the presence of a reducing agent. In one embodiment the process comprises a one step bleaching process in the presence of a reductive bleaching agent. In another embodiment the process comprises a two-step bleaching process including a first step carried out in the presence of a peroxide bleaching agent, and a second step comprising adding a reducing agent after consumption of the peroxide bleaching agent.

In accordance with another aspect of the invention, there has been provided a complex former combination for use in the oxidative or reductive bleaching of wood pulp, comprising as components at least one phosphonic acid, at least one polyhydroxycarboxylic acid and at least one phosphate, or salts of these components.

Further objects, features and advantages of the invention will become apparent from the detailed description of preferred embodiments which follows.

DETAILED DESCRIPTION OF THE PREFERRED EMBODIMENTS

Products which are known as peroxide stabilizers have been tried, in the case of a perioxide bleaching bath. However, it was completely unexpectedly ascertained that these products, in spite of their excellent stabilizing action upon peroxides, only gave insufficient bleaching effects.

In the case of reducing agents, it was shown that, apart from the salts of sulphurous acid, also those of amidoimidomethanesulphinic acid, phosphorous acid, metal hydrides, hydrazines and hydroxylamines, as well as further available reduction agents (see Ullmann, Volume 20, page 125 et seq.), are outstandingly suitable as adjuvants in the case of bleaching. These can be used individually or in combination.

Surprisingly, the problem with which the present invention is concerned is solved by the use of a combination of phosphonic acids, polyhydroxycarboxylic acids and phosphates. These compounds themselves do not possess any bleaching action, or they display only a small stabilization of the bleach in question and some of them even have a destabilizing action.

Thus, according to the present invention, there is provided a process for the oxidative or reductive bleaching of wood pulp, especially in the presence of heavy metal salts, in which a complex former combination containing at least one phosphonic acid, at least one polyhydroxycarboxylic acid and at least one phosphate or salts thereof is added to a wood pulp slurry in an amount of from about 0.5 to 50%, based upon the dry mass of the wood pulp, wherein subsequent bleaching is carried out in the presence of a reducing agent.

As phosphonic acids, there can be used, for example, N,N-bis-(carboxymethyl)-1-aminoethane-1,1-diphosphonic acid, N-2-carboxyethyl-1-aminoethane-1,1-diphosphonic acid, N,N-bis-(hydroxymethly)-1-aminoethane-1,1-diphosphonic acid, 1,2,1-tricarboxybutane-2-phosphonic acid, diethylenetriamine-pentamethylenephosphonic acid (DTPMP), hydroxyethanediphosphonic acid (HEDP) and aminotrismethylenephosphonic acid (ATMP) and the corresponding salts of these acids.

As polyhydroxycarboxylic acids, there can be used, for example, gluconic acid, citric acid, N,N-dihydroxyethyleneglycine, diethylenetriamine-pentaacetic acid (DTPA), ethylenediamine-tetraacetic acid (EDTA) and nitrilotriacetic acid (NTA) and the corresponding salts of these acids.

As phosphate components, there can be used, for example, the corresponding alkali metal and alkaline earth metal salts of orthophosphoric and polyphosphoric acid.

It is preferred to use the said components in a mixture ratio between the limits of about 80:10:10, about 10:10:80 and about 10:80:10. By means of the joint use of these compounds, a synergistic effect results which is especially surprising because the individual components or combinations of only two of them merely exert an insufficient bleaching action or have a destabilizing effect on the oxidation or reduction agent (see, for example, German Offenlegungsschrift No. 33 38 260).

Due to the above-mentioned closure of the cycle, the heavy metal content increases so that, in spite of the complexing agent, the whiteness is not satisfactory. One of the reasons for this is that it is irreversibly destroyed by the heavy metal ions. Due to the high concentration of the heavy metals, an aging of the paper is induced which involves a significant loss of whiteness. This effect cannot be suppressed by the addition of large amounts of complexing agents. Surprisingly, however, we have found that this effect is prevented by the addition of reducing agents. In the normal case of peroxide bleaching, the addition of the reducing agent takes place after the consumption of the oxidizing agent.

In the case of reductive bleaching, this process can, on the other hand, be carried out in one process step. Completely unexpectedly, it has also been shown that the reducing agent can be incorporated into the complexing agent without problems arising. In this way, a further simplification of the process is achieved. The thus-formulated product permits a satisfactory peroxide bleaching, with the resistance to aging of the paper thereby being ensured. Furthermore, this complexing agent makes possible a very good bleaching, even if it is used by itself, i.e., without the addition of conventional bleaching chemicals. Consequently, a particularly environmentally satisfactory procedure is possible.

The following examples are given for the purpose of illustrating the present invention, without being limitative.

EXAMPLES

According to the present state of th art, a bleaching formulation can have the following composition:

| | |
|---|---|
| (a) peroxide bleach: | |
| hydrogen peroxide | 1.5–2% |
| aqueous sodium hydroxide solution | 1.5–2% |
| waterglass | 1.0–5% |
| (b) reductive bleach: | |
| sodium dithionite | 0.5–2% |

The experiments were carried out in the following manner:

100 g. of an aqueous pulp of 3 to 10% stock density was bleached at 40° to 100° C. and preferably at 55° to 65° C. at a pH value of from 8 to 12 and with a hydrogen peroxide addition of 1.5 to 2%. The residence time was up to 8 hours and preferably 2 hours. Thereafter, the batch was acidified with sulphuric acid.

Subsequently, the reducing agent was added in a concentration of 0.5 to 5%, based on the pulp. The heavy metal content of the water used was 100 ppm. In the case of the reductive bleaching, the composition according to the present invention was used in one process step. As the following examples show, a distinctly greater degree of whiteness can be achieved with the process according to the present invention than in the case of a comparative experiment.

EXAMPLE 1

4% Waterglass. Degree of whiteness 8 points.

EXAMPLE 2

As in Example 1 except that the 4% waterglass was replaced by 1% of one of the following compounds:

| | | |
|---|---|---|
| DTPA | degree of whiteness | 6.6 points |
| EDTA | " | 6.0 points |
| NTA | " | 7.0 points |
| alkali metal orthophosphate | " | 6.4 points |

EXAMPLE 3

As in Example 1 but instead of 4% waterglass, 1% of a combination of the following compounds was used:

45 parts N,N-bis-(hydroxymethyl)-1-aminoethane-1,1-diphosphonic acid
16 parts phosphoric acid
15 parts potassium hydroxide remainder water.
Degree of whiteness 7 points.

EXAMPLE 4

The experiment was carried out as in Example 1 but with the use of one of the following combinations:

(a)
20 parts DTDMP
16 parts phosphoric acid
27 parts water
10 parts potassium hydroxide
10 parts DTPA
Degree of whiteness 13.4 points.

(b)
20 parts N,N-bis-(hydroxymethyl)-1-aminoethane-1,1-diphosphonic acid
20 parts phosphoric acid
20 parts polyphosphate
8 parts DTPA remainder water
Degree of whiteness 13.7 points (c)
25 parts DTPMP
20 parts polyphosphate
20 parts EDTA
20 parts potassium hydroxide remainder water
Degree of whiteness 10.5 points.

EXAMPLE 5

As in Example 4+0.5% reducing agent.

(a)
20 parts DTPMP
16 parts phosphoric acid
27 parts water
10 parts DTPA +0.5% amidoiminomethanesulphinic acid
Degree of whiteness 15.4 points (b)
20 parts N,N-bis-(hydroxymethyl)-1-aminoethane-1,1-diphosphonic acid
20 parts phosphoric acid
30 parts potassium hydroxide
8 parts DTPA+0.5% hydroxylammonium sulphate remainder water Degree of whiteness 16 points.

(c)

20 parts DTPMP
20 parts polyphosphate
20 parts EDTA
20 parts potassium hydroxide+0.5% hydroxylamine sulphate
remainder water
Degree of whiteness 16 points.

EXAMPLE 6

Reductive bleaching with dithionite

The experiment was carried out at a stock density of 5% with the exclusion of oxygen. The pH value was 8, the bleaching temperature 60° C. and the residence time 1 hour. The complexing agent was dosed in at 1%, as well as the sodium dithionite. The following results were obtained:

| | | |
|---|---|---|
| without additive | degree of whiteness | 7 points |
| 1% DTPA | " | 8 points |
| 1% DTPMP | " | 7 points |
| 1% hexametaphosphate | " | 5 points |
| 1% alkali metal orthophosphate | " | 1 point |
| a mixture of 15 parts N—2-carboxyethyl-1-aminoethane-1,1-diphosphonic acid, 16 parts phosphoric acid, 27 parts potassium hydroxide, 12 parts DTPA, remainder water | " | 11 points |

EXAMPLE 7

As in Example 6 but using a mixture of
25 parts DTPMP
20 parts polyphosphate
20 parts EDTA
20 parts potassium hydroxide+1% hydroxylamine sulphate
remainder water
Degree of whiteness 14 points.

EXAMPLE 8

Mechanical wood pulp 5% SC, pH value 6.0, temperature 60° C., bleaching time 1 hour, using 1% of a mixture of
25 parts DTPMP
20 parts polyphosphate
20 parts DTPA
20 parts potassium hydroxide
15 ml. hydroxylamine phosphate
Degree of whiteness 9 points.

EXAMPLE 9

TMP (thermomechanical pulp, thermo-refined wood pulp), 2% hydrogen peroxide, 1% sodium hydroxide, 0.25% DTPA; temperature 50° C., 12% stock density, 60 minutes bleaching time. Degree of whiteness 5 points.

EXAMPLE 10

TMP, 2% hydrogen peroxide, 1% sodium hydroxide, 0.25% of a mixture of 20 parts DTPMP, 20 parts polyphosphate, 10 parts DTPA, 20 parts potassium hydroxide, remainder water. Degree of whiteness 8 points.

EXAMPLE 11

CTMP (chemical thermomechanical pulp); wood chips were impregnated with 2.0% sodium sulphate and 0.6% DTPA, disintegrated and subsequently bleached with 2% hydrogen peroxide and 1% sodium hydroxide. Degree of whiteness 5 points.

EXAMPLE 12

As in Example 11 but the DTPA was replaced by a mixture of 20 parts N,N-bis-(hydroxymethyl)-1-aminoethane-1,1-diphosphonic acid, 20 parts phosphonic acid, 20 parts potassium hydroxide, 8 parts DTPA and 42 parts hydroxylamine sulphate. Degree of whiteness 8 points.

EXAMPLE 13

100 g. of waste paper were broken up with water and bleached at a stock density of 6% with 2% hydrogen peroxide and 1% sodium hydroxide with the addition of 0.5% DTPA. Degree of whiteness 10 points.

EXAMPLE 14

As in Example 13, except that the DTPA was replaced by 0.2% of a mixture of 20 parts DTPMP, 20 parts phosphoric acid, 20 parts potassium hydroxide, 10 parts DTPA, remainder water. Degree of whiteness 13 points.

EXAMPLE 15

As in Example 13, except that the DTPA was replaced by a mixture of 20 parts DTMP, 20 parts polyphosphate, 10 parts DTPA and 50 parts hydroxylamine phosphate. Degree of whiteness 15 points.

The above Examples clearly show that, with the bleaching adjuvant according to the present invention, substantially better stabilization and degree of whiteness are achieved than with the individual components. Apart from the disturbing waterglass, which can be completely replaced, excellent degrees of whiteness are also achieved in the case of high concentrations of heavy metal ions. Thus, in the case of the use of the products according to the present invention, the loading of the circulating water with chemicals is reduced. This, together with the above-described advantages, results overall in a disturbance-free operation and thus in an increased effectiveness.

What is claimed is:

1. A process for bleaching wood pulp, comprising a step of: oxidatively bleaching a wood pulp slurry with an oxidative bleaching agent in the present of an amount of from about 0.5 to 50% by weight based upon the dry mass of the wood pulp of a complex former combination comprising as components at least one phosphonic acid, at least one polyhydroxy carboxylic acid and at least one phosphate, or salts of said components, wherein at least a portion of said oxidative bleaching step is carried out in the present of an amount of from about 0.5 to 5% by weight based on the dry mass of the wood pulp of a reducing agent.

2. A process according to claim 1, wherein said oxidative bleaching agent is peroxide.

3. A process according to claim 1, further comprising a step of adding a reductive bleaching agent after consumption of the peroxide bleaching agent.

4. A process according to claim 1, wherein the reducing agent comprises at least one compound comprising a salt of amidoimidomethanesulphinic acid or of phosphorous acid, or a hydroxylamine.

5. A process according to claim 1, wherein said phosphonic acid is selected from the group consisting of N,N-bis-(carboxymethyl)-1-aminoethane-1,1-diphosphonic acid, N-2-carboxyethyl-1-aminoethane-1,1-diphosphonic acid, N,N-bis-(hydroxymethyl)-1-aminoethane-1,1-diphosphonic acid, 1,2,1-tricarbonxybutane-2-phosphonic acid, diethylenetriamine-pentamethylenephosphonic acid, hydroxyethanediphosphonic acid and aminotrismethylenephosphonic acid.

6. A process according to claim 1, wherein said polyhydroxycarboxylic acid is selected from the group consisting of gluconic acid, citric acid, N,N-dihydroxyethyleneglycine, diethylenetriamine-pentaacetic acid, ethylenediamine-tetraacetic acid and nitrolotriacetic acid.

7. A process according to claim 1, wherein said phosphate component is selected from the alkali and alkaline earth metal salts of orthophosphoric acid and polyphosphoric acid.

8. A process according to claim 1, wherein said components are present in a weight ratio of from about 80 to 10:10 to 80:10 to 80.

9. A process according to claim 1, further comprising a step of reductively bleaching with dithionic acid or sulfurous acid, following said oxidative bleaching step.

* * * * *